US010357808B2

(12) United States Patent
Lewis

(10) Patent No.: US 10,357,808 B2
(45) Date of Patent: Jul. 23, 2019

(54) METHODS AND SYSTEMS FOR USE IN WASHING BULK CONTAINERS

(71) Applicant: Lonny Shawn Lewis, Ursa, IL (US)

(72) Inventor: Lonny Shawn Lewis, Ursa, IL (US)

( * ) Notice: Subject to any disclaimer, the term of this patent is extended or adjusted under 35 U.S.C. 154(b) by 356 days.

(21) Appl. No.: 15/170,399

(22) Filed: Jun. 1, 2016

(65) Prior Publication Data

US 2016/0271653 A1 Sep. 22, 2016

Related U.S. Application Data

(62) Division of application No. 14/040,863, filed on Sep. 30, 2013, now Pat. No. 9,381,551.

(51) Int. Cl.

| | |
|---|---|
| ***B08B 3/02*** | (2006.01) |
| ***B08B 9/08*** | (2006.01) |
| ***B08B 3/00*** | (2006.01) |
| ***B08B 3/08*** | (2006.01) |
| *B08B 9/093* | (2006.01) |

(52) U.S. Cl.

CPC ..... *B08B 3/024* (2013.01); *B08B 3/003* (2013.01); *B08B 3/08* (2013.01); *B08B 9/0813* (2013.01); *B08B 9/0826* (2013.01); *B08B 9/08* (2013.01); *B08B 9/0821* (2013.01); *B08B 9/0861* (2013.01); *B08B 9/093* (2013.01)

(58) Field of Classification Search

CPC ..... B08B 3/024

See application file for complete search history.

(56) References Cited

U.S. PATENT DOCUMENTS

| | | | |
|---|---|---|---|
| 1,539,031 | A | 5/1925 | Thomson |
| 3,606,091 | A | 9/1971 | Grisham |
| 4,325,775 | A | 4/1982 | Moeller |
| 4,351,478 | A | 9/1982 | Looper |
| 4,427,456 | A | 1/1984 | Rowan |
| 4,694,846 | A | 9/1987 | Bouchard |
| 4,863,009 | A | 9/1989 | Winkel et al. |
| 5,964,229 | A | 10/1999 | Brendel |
| 6,932,094 | B2 | 8/2005 | Chen et al. |
| 7,225,816 | B2 | 6/2007 | Byers |
| 7,846,263 | B1 | 12/2010 | Marcantel |
| 2004/0159336 | A1 | 8/2004 | Feistmantl |
| 2008/0178412 | A1 | 7/2008 | Kiter |
| 2008/0289665 | A1 | 11/2008 | Dwyer |

(Continued)

FOREIGN PATENT DOCUMENTS

| | | |
|---|---|---|
| EP | 1816096 B1 | 3/2009 |
| JP | 04045726 A | 2/1992 |

OTHER PUBLICATIONS

"Seed Box Automation," Green Age Products and Services, LLC, retrieved from website http://greenageproducts.com/seed-box-automation-michigan/.

(Continued)

*Primary Examiner* — Jason Y Ko

(74) *Attorney, Agent, or Firm* — Armstrong Teasdale LLP

(57) ABSTRACT

A method of washing a bulk container is provided. The method includes receiving the bulk container on a support surface and rotating the support surface and at least one washer arm relative to one another. The method further includes spraying a fluid from at least one nozzle disposed on the at least one washer arm. Rotating the support surface and the at least one washer arm relative to one another exposes a plurality of portions of an outer surface of the bulk container to the spray.

20 Claims, 5 Drawing Sheets

(56) References Cited

U.S. PATENT DOCUMENTS

| | | | |
|---|---|---|---|
| 2010/0122717 | A1 | 5/2010 | Yoon et al. |
| 2010/0170537 | A1 | 7/2010 | Gingras |

OTHER PUBLICATIONS

Advertisement for "Complete TurnKey Seed Bulk Box Processing Systems," Green Age Products and Services, LLC, Seed Today Magazine, Fourth Quarter 2012, p. 46.

METHODS AND SYSTEMS FOR USE IN WASHING BULK CONTAINERS

CROSS REFERENCE TO RELATED APPLICATION

This application is a divisional application of U.S. patent application Ser. No. 14/040,863 entitled METHODS AND SYSTEMS FOR USE IN WASHING BULK CONTAINERS, filed Sep. 30, 2013, the disclosure of which is fully incorporated herein by reference.

BACKGROUND OF THE INVENTION

This invention relates generally to washing systems and, more particularly, to a system for washing bulk containers.

Re-usable bulk containers are used by suppliers to deliver commodities or goods to customers. The customer may store the container in an area exposed to dust or other contaminants. In some cases, the customer also may incorporate the container into the customer's process for using the good or commodity. For example, seed suppliers may provide seeds to farmers in bulk containers, and those containers may be coupled to a planter to provide seeds as needed while the farmer sows a field using the planter. Through delivery and customer storage and usage of the containers, outside surfaces of the containers may become encrusted with dust, dirt, or other unsightly or unsanitary matter. Typically, a re-usable container is returned to the supplier after the customer removes the good or commodity. The supplier may wish to wash the outside surfaces of the container before refilling and distributing the container to another customer.

The outside surfaces of such containers may be washed by an individual wielding a water hose and left to dry in the ambient air. However, such manual washing is labor-intensive and time-consuming, and ambient air drying also is time-consuming. Moreover, while systems for washing bulk containers are known, such systems focus on the inside of the containers, where special handling and disposal procedures may be needed if a good or commodity last held by the container included regulated substances. Accordingly, such known washing systems are complicated and expensive to maintain and operate.

BRIEF DESCRIPTION OF THE INVENTION

In one embodiment, a method of washing a bulk container is provided. The method includes receiving the bulk container on a support surface and rotating the support surface and at least one washer arm relative to one another. The method further includes spraying a fluid from at least one nozzle disposed on the at least one washer arm. Rotating the support surface and the at least one washer arm relative to one another exposes a plurality of portions of an outer surface of the bulk container to the spray.

In another embodiment, a system for washing a bulk container is provided. The system includes at least one washer arm and at least one nozzle disposed on the at least one washer arm. The at least one nozzle is operable to spray a fluid at least partially into a coverage zone. The system also includes a support surface configured to receive the bulk container and position it at least partially within the coverage zone. At least one of the support surface and the at least one washer arm is rotatable relative to the other.

DETAILED DESCRIPTION OF THE INVENTION

The exemplary methods, apparatus, and systems described herein overcome disadvantages associated with known methods of washing bulk containers. The embodiments described herein facilitate reducing a time, an amount of manual effort, and a cost required for washing the outer surfaces of bulk containers.

A "bulk" container refers to a container sized to hold a load capacity in the range of about 500 pounds to about 5,000 pounds. A bulk container may be fabricated from plastic, metal, or any other suitable material. Such containers may have a footprint that covers an area in the range of about 7 square feet to about 25 square feet and a height in the range of about 30 inches to about 80 inches. For example, a plastic bulk container used for seeds may have a 45 inch by 48 inch footprint, a 39 inch height, and a load capacity of 2,000 pounds. For another example, a plastic bulk container used for seeds may have a 45 inch by 56 inch footprint, a 65 inch height, and a load capacity of 2,500 pounds.

Figure 1:
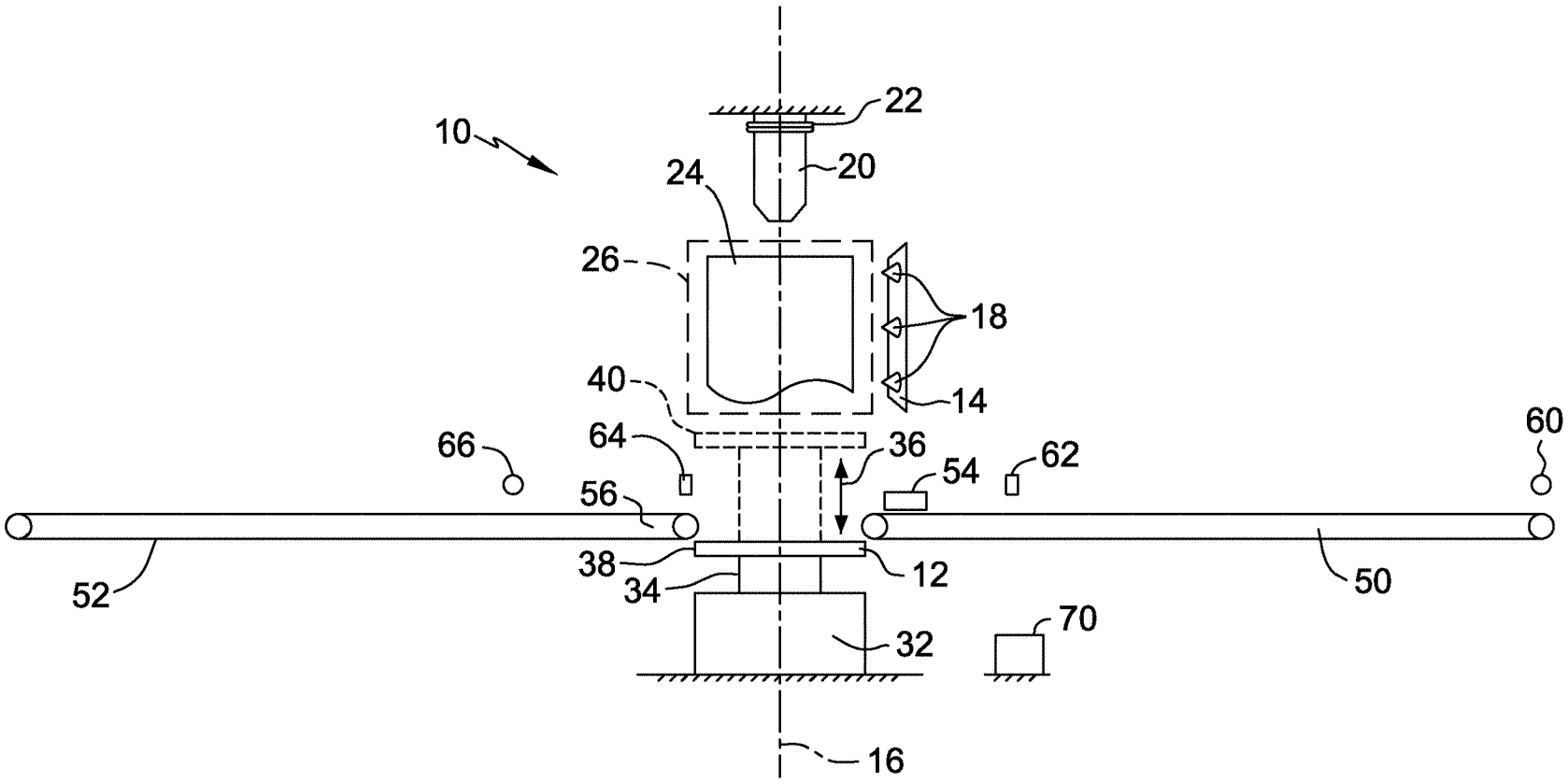
FIG. 1 is a schematic view of an exemplary washing system.

FIG. 1 illustrates a schematic view of an exemplary washing system 10 that includes a support surface 12 and at least one washer arm 14. In the exemplary embodiment, the at least one washer arm 14 is fixed, while support surface 12 is rotatable about a substantially vertical axis 16. In another embodiment, support surface 12 is fixed with respect to rotation, while the at least one washer arm 14 is rotatable about axis 16.

In some embodiments, at least one nozzle 18 is disposed on the at least one washer arm 14. Three nozzles 18 are shown in the exemplary embodiment in FIG. 1. Each nozzle 18 is in flow communication with a supply of fluid (not shown). In some embodiments, the fluid is water. In other embodiments, the fluid is a cleaning fluid such as, but not limited to, a detergent foam or water containing a detergent. In still other embodiments, the fluid is a plurality of fluids, for example a first fluid including a detergent foam and a second fluid including water, and the at least one nozzle 18 is configured to be switched into flow communication with each of the plurality of fluids. In some embodiments, the at least one washer arm 14 is a plurality of washer arms 14 each containing at least one nozzle 18. The at least one nozzle 18 is positioned on the at least one washer arm 14 such that it is operable to spray the fluid at least partially into a coverage zone 26.

In some embodiments, support surface 12 and the at least one washer arm 14 are configured to move relative to each other along at least one direction 36. For example, in the exemplary embodiment, support surface 12 is supported by a base 32 and a first actuator 34. First actuator 34 can move support surface 12 along the at least one direction 36 between a first position 38 and a second position 40 (shown in dotted lines in FIG. 1). When support surface 12 is in the first position 38, it is disposed to receive a bulk container (not shown) from a feed source, for example from a feed conveyor belt 50. In some embodiments, feed conveyor belt 50 includes a plurality of conveyor belts arranged in series. When support surface 12 is in the second position 40, support surface 12 is disposed to position a received bulk container (not shown) at least partially within coverage zone 26 associated with the at least one washer arm 14. In some embodiments, feed conveyor belt 50 is a rail conveyor belt, and base 32 is located between the rails such that a travel path of a bulk container (not shown) on feed conveyor belt 50 extends over base 32. In such embodiments, support surface 12 lies at or below the level of the rails in the first position 38 to receive a bulk container (not shown), and support surface 12 operates to lift the bulk container (not shown) above the level of the rails in the second position 40 so that the rails do not impede the relative rotation of support surface 12 and the at least one washer arm 14.

In alternative embodiments, support surface 12 is fixed with respect to the at least one direction 36 such that a bulk container (not shown) may be received on support surface 12 and lie at least partially within coverage zone 26. In some such embodiments, support surface 12 is a portion of feed conveyor belt 50, rather than a separate surface.

The exemplary washing system 10 also includes a drying vent 20 in flow communication with a supply of air (not shown). In the exemplary embodiment, an outlet direction of air flowing from drying vent 20 may be changed by a positioning device 22. In a first position set by positioning device 22, drying vent 20 may be disposed to provide air into a first portion of coverage zone 26, and in a second position set by positioning device 22, drying vent 20 may be disposed to provide air into a second portion of coverage zone 26. For example, in a first position, drying vent 20 may be disposed to provide air at least partially into a top portion of coverage zone 26. In addition, a side wall 24 may be disposed adjacent coverage zone 26, such that in a second position, drying vent 20 may be disposed to provide air at least partially towards side wall 24 such that the air is re-directed, at least in part, into a side portion of coverage zone 26. Side wall 24 may be, for example, a hanging plastic curtain, a wall of a structure in which system 10 is housed, a partition, or any other structure that can serve to re-direct air flowing from drying vent 20 in the manner described. In other embodiments, a plurality of drying vents 20 may be disposed to provide air to, respectively, a plurality of portions of coverage zone 26.

A bulk container removal device, such as a removal conveyor belt 52 in the exemplary embodiment, may be used to facilitate a removal of a bulk container (not shown) from washing system 10 after a washing and/or drying process. In some embodiments, removal conveyor belt 52 includes a plurality of conveyor belts arranged in series. In the exemplary embodiment, when support surface 12 is in first position 38, a second actuator 54 may be activated to reposition a bulk container (not shown) away from support surface 12 and onto a first portion 56 of removal conveyor belt 52. In other embodiments, where feed conveyor belt 50 is a rail conveyor belt and base 32 is positioned between the rails, feed conveyor belt 50 may cooperate in series with removal conveyor belt 52 to deposit the bulk container on the first portion 56 of removal conveyor belt 52. In alternative embodiments, a bulk container may be removed from support surface 12 in any other suitable manner, including manually.

The exemplary system 10 further includes a first position sensor 60 and a first stop 62. Feed conveyor belt 50 is configured to move one or more bulk containers (not shown) towards support surface 12. First position sensor 60 is configured to facilitate a detection of the number of bulk containers on feed conveyor belt 50, for example, by detecting when each bulk container is loaded onto an end of feed conveyor belt 50. First stop 62 is configured to prevent feed conveyor belt 50 from depositing a second bulk container (not shown) onto support surface 12 when a first bulk container (not shown) is positioned on support surface 12. After the first bulk container is removed from support surface 12, for example by operation of second actuator 54, first stop 62 operates to permit the second bulk container to be deposited on support surface 12.

The exemplary system 10 also includes a second stop 64 configured to retain on support surface 12 a bulk container (not shown) deposited by feed conveyor belt 50. After completion of a washing and/or drying process for the bulk container received on support surface 12, second stop 64 operates to permit the bulk container to be moved from support surface 12 to removal conveyor belt 52. A second position sensor 66 is configured to detect when a bulk container (not shown) has been moved to removal conveyor belt 52.

In the exemplary embodiment, washing system 10 is configured to be controlled by a control system 70. For example, each of support surface 12, the at least one washer arm 14, the at least one nozzle 18, drying vent 20, positioning device 22, first actuator 34, feed conveyor belt 50, removal conveyor belt 52, second actuator 54, first position sensor 60, first stop 62, second stop 64, and second position sensor 66 may be in wired or wireless communication with control system 70, may operate in response to signals received from control system 70, and may signal a status or operating state to control system 70. In the exemplary embodiment, control system 70 is a programmable industrial process controller configured to control at least one of an initiation, duration, or conclusion of the relative rotation of support surface 12 and the at least one washer arm 14, as well as at least one of an initiation, duration, or conclusion of the spraying of fluid by the at least one nozzle 18. In other embodiments, control system 70 is any suitable control system known in the art, such as, but not limited to, manual switch activation of the relative rotation of support surface 12 and the at least one washer arm 14 or the spraying of fluid by the at least one nozzle 18.

Figure 2:
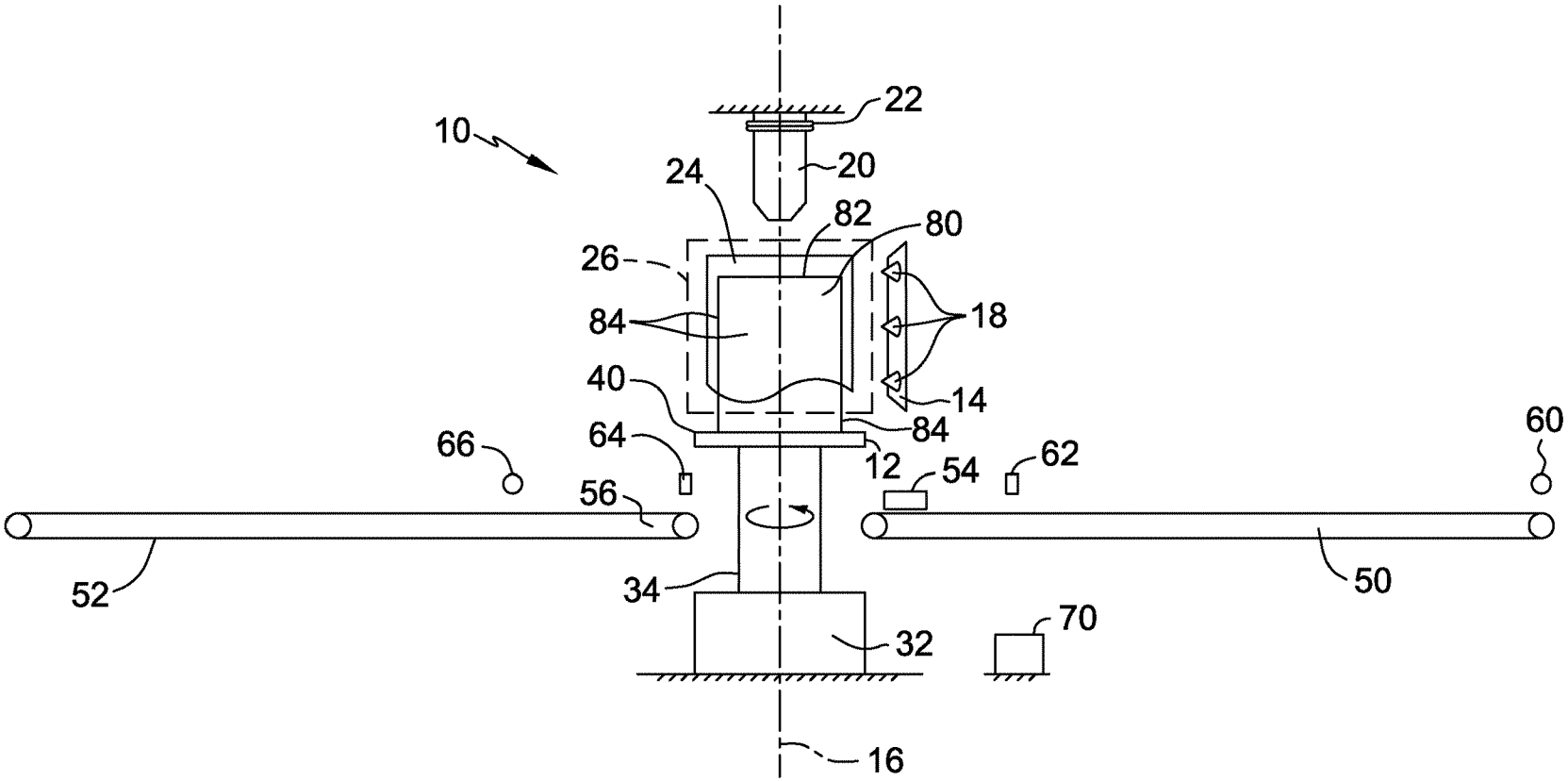
FIG. 2 is a schematic view of the exemplary washing system shown in FIG. 1 in operation to wash a bulk container.

FIG. 2 illustrates a schematic view of the exemplary washing system 10 shown in FIG. 1 in operation to wash a bulk container 80. In the exemplary embodiment, bulk container 80 is positioned on support surface 12. Support surface 12 is in second position 40 such that at least a portion of bulk container 80 lies within coverage zone 26. Support surface 12 rotates bulk container 80 relative to the at least one washer arm 14. As the at least one nozzle 18 sprays fluid, the relative rotation of support surface 12 and the at least one washer arm 14 exposes a plurality of portions of an outer surface of bulk container 80, for example a top surface 82 and a plurality of side surfaces 84, to the spray. In some other embodiments, where support surface 12 is fixed with respect to rotation while the at least one washer arm 14 is rotatable, the relative rotation of support surface 12 and the at least one washer arm 14 likewise exposes a plurality of portions of the outer surface of bulk container 80 to the spray. The spray facilitates a washing of the outer surface of bulk container 80.

Further in the exemplary embodiment shown in FIG. 2, after a desired amount of washing, the drying vent 20 provides air to the plurality of portions of the outer surface of bulk container 80 to facilitate a drying of the outer surface of bulk container 80. For example, drying vent 20 may be disposed in a first position to provide air at least partially to top surface 82, and then drying vent 20 may be disposed in a second position to provide air at least partially towards side wall 24 such that it is re-directed, at least in part, towards bulk container 80. In the exemplary embodiment, support surface 12 rotates bulk container 80 during at least a portion of the time that drying vent 20 flows air, such that multiple portions of the plurality of portions of the outer surface of bulk container 80, for example each of the plurality of side surfaces 84, are exposed to the air provided from drying vent 20. In other embodiments, a plurality of drying vents 20 provides air to, respectively, a plurality of portions of the outer surface of bulk container 80. In some embodiments, support surface 12 does not rotate bulk container 80 during the drying process.

Figure 3:
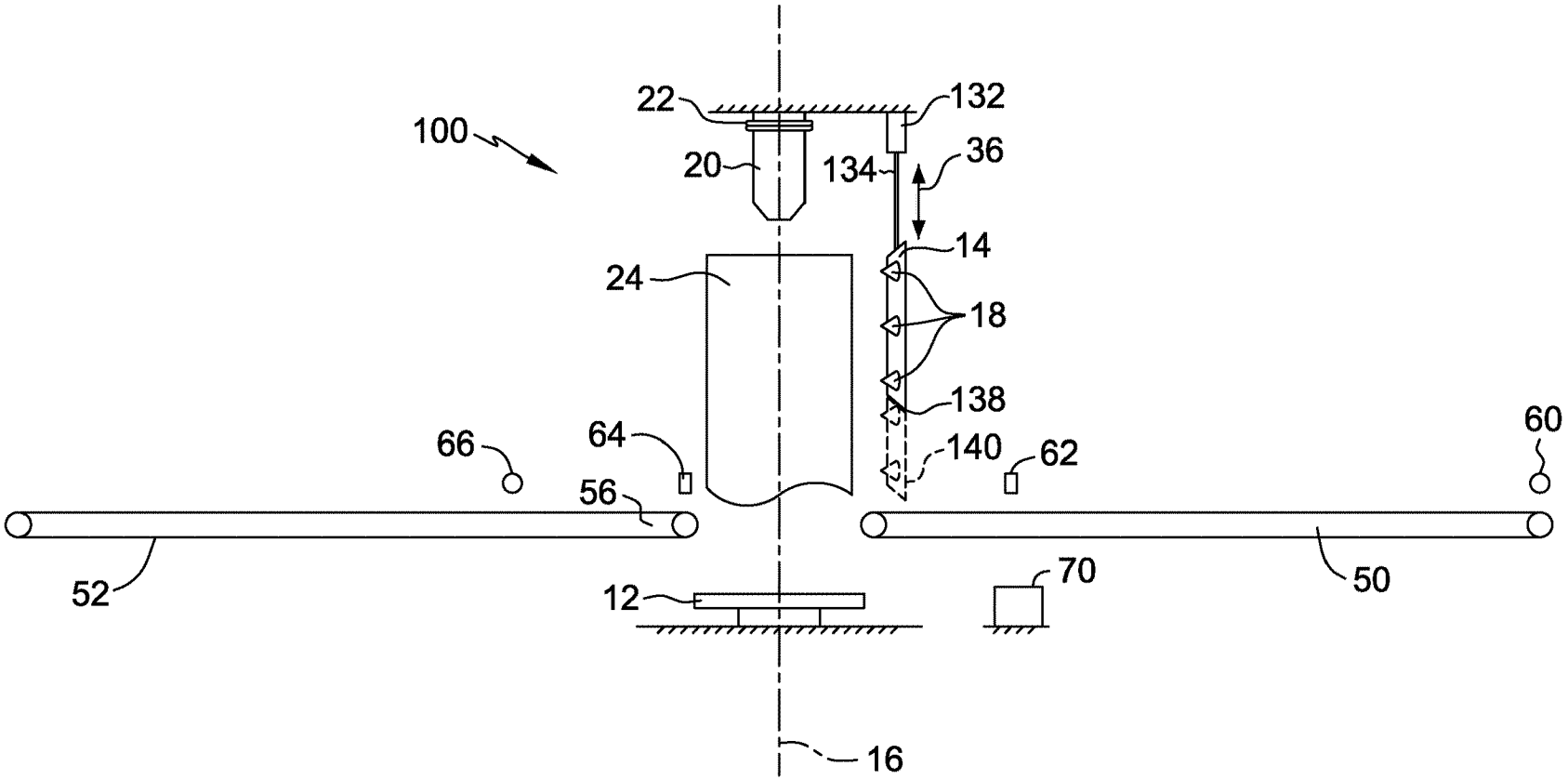
FIG. 3 is a schematic view of another exemplary washing system.

FIG. 3 is a schematic view of an exemplary washing system 100 in which support surface 12 is fixed with respect to the at least one direction 36, while the at least one washer arm 14 is configured to move along the at least one direction 36. For example, in the exemplary embodiment shown in FIG. 3, the at least one washer arm 14 is supported by a base 132 and a first actuator 134. First actuator 134 can move the at least one washer arm 14 along the at least one direction 36 between a first position 138 and a second position 140. When the at least one washer arm 14 is in first position 138, it is disposed not to interfere with the receipt by support surface 12 of a bulk container (not shown) from a feed source, for example from feed conveyor belt 50. When the at least one washer arm 14 is in second position 140, the bulk container (not shown) received by support surface 12 lies at least partially within coverage zone 26 associated with the at least one washer arm 14. For example, when the at least one washer arm 14 is in second position 140, a relative rotation of support surface 12 and the at least one washer arm 14 about the substantially vertical axis 16 exposes a plurality of portions of the outer surface of the received bulk container (not shown) to the spray from the at least one nozzle 18.

Figure 4:
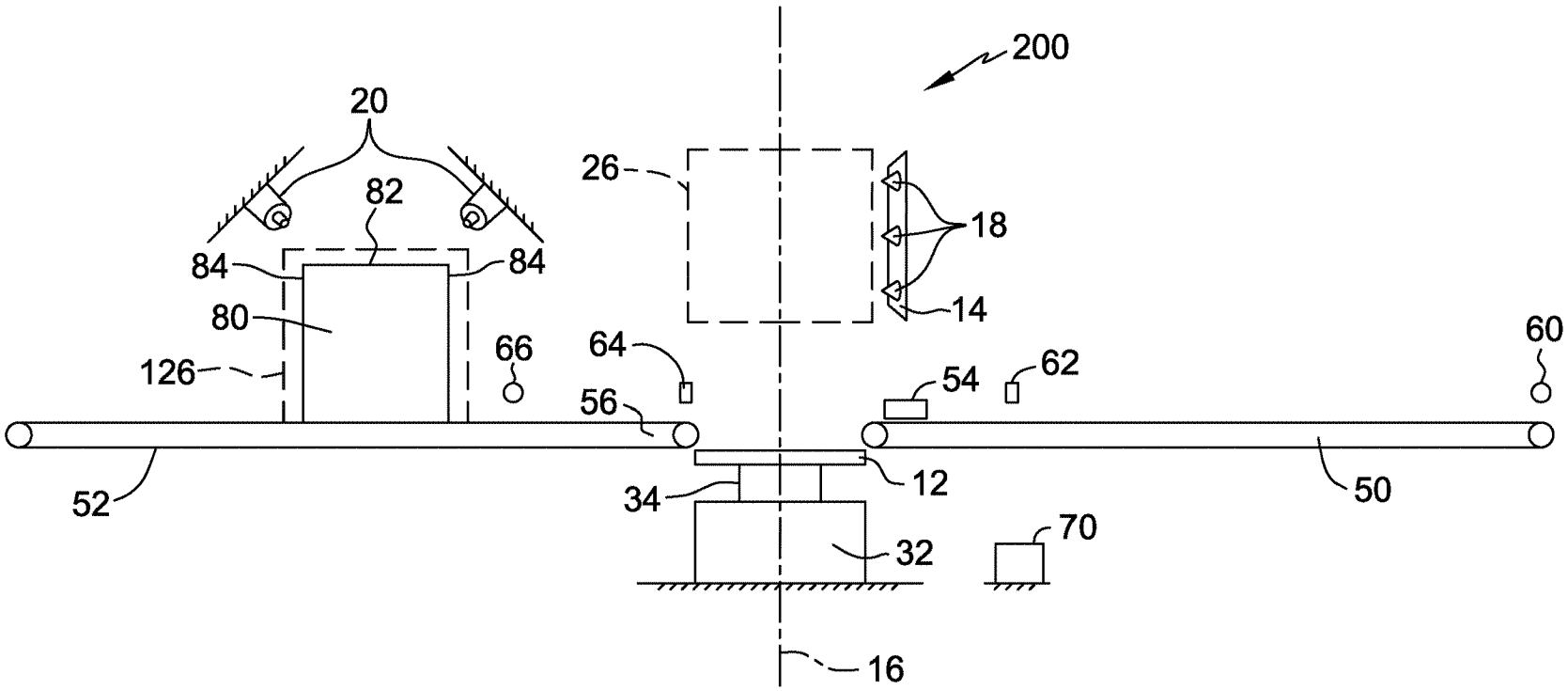
FIG. 4 is a schematic view of still another exemplary washing system.

FIG. 4 illustrates a schematic view of an exemplary washing system 200 in which drying vent 20 is a plurality of drying vents 20 positioned adjacent removal conveyor belt 52 to facilitate a drying of an outer surface of bulk container 80. In the exemplary embodiment of FIG. 4, the plurality of drying vents 20 are positioned to provide air to, respectively, a plurality of portions of a dryer coverage zone 126. When bulk container 80 is moved from support surface 12, it is repositioned, for example by removal conveyor belt 52, within dryer coverage zone 126 such that at least one of the plurality of drying vents 20 provides air to each of the plurality of portions of the outer surface of bulk container 80, for example top surface 82 and plurality of side surfaces 84. In this embodiment, a separate bulk container (not shown) may be washed by the at least one nozzle 18 while the outer surface of bulk container 80 is dried.

Figure 5:
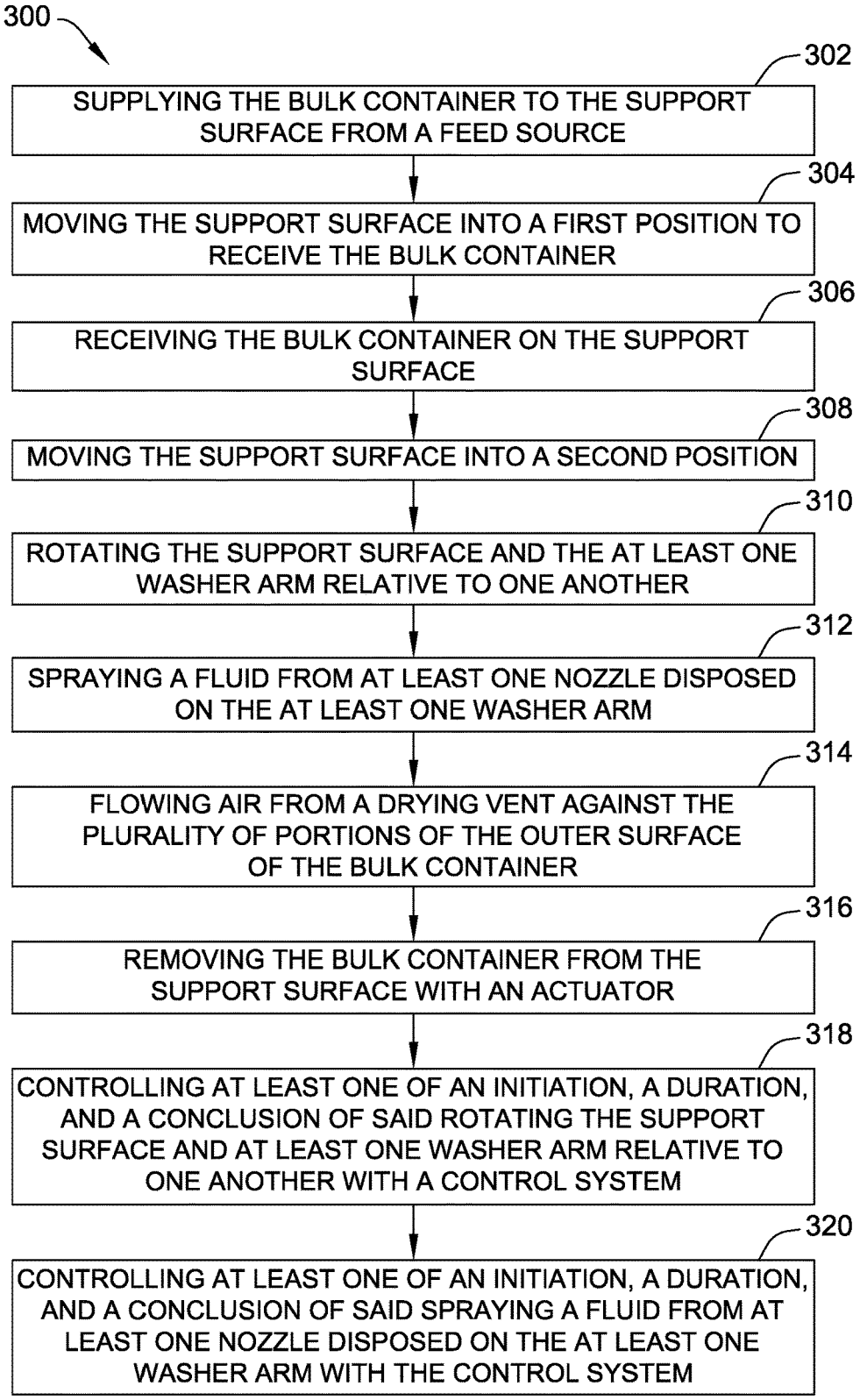
FIG. 5 is a flow chart illustrating an exemplary method of washing a bulk container.

FIG. 5 is a flow chart illustrating an exemplary method 300 of washing a bulk container. The method 300 includes supplying 302 bulk container 80 to support surface 12 from a feed source, such as feed conveyor belt 50. The exemplary method 300 also includes moving 304 support surface 12 into first position 38 to receive bulk container 80, and receiving 306 bulk container 80 on support surface 12. The exemplary method 300 further includes moving 308 support surface 12 into second position 40, rotating 310 support surface 12 and the at least one washer arm 14 relative to one another, and spraying 312 a fluid from the at least one nozzle 18 disposed on the at least one washer arm 14.

The exemplary method 300 additionally includes providing 314 air from drying vent 20 to a plurality of portions of the outer surface, such as top surface 82 and plurality of side surfaces 84, of bulk container 80. It further includes removing 316 bulk container 80 from support surface 12, for example, by moving it with second actuator 54. The exemplary method 300 also includes controlling 318 at least one of an initiation, a duration, and a conclusion of rotating support surface 12 and the at least one washer arm 14 relative to one another with control system 70, as well as controlling 320 at least one of an initiation, a duration, and a conclusion of the spraying of fluid from the at least one nozzle 18 disposed on the at least one washer arm 14 with control system 70.

The methods and systems for washing bulk containers described herein facilitate reducing a time, an amount of manual effort, and a cost required for washing the outer surfaces of bulk containers. As such, the methods and systems described herein facilitate a more efficient and cost-effective preparation of used bulk containers for redistribution to customers.

Exemplary embodiments of washing systems for bulk containers are described above in detail. The methods and systems are not limited to the specific embodiments described herein nor to the specific illustrated methods and systems. While the invention has been described in terms of various specific embodiments, those skilled in the art will recognize that the invention can be practiced with modification within the spirit and scope of the claims.

What is claimed is:

1. A system for washing a bulk container comprising:

at least one washer arm;

at least one nozzle disposed on said at least one washer arm, said at least one nozzle operable to spray a fluid at least partially into a coverage zone; and a support surface configured to receive the bulk container atop the support surface and position it at least partially within the coverage zone, said support surface defining an axis normal to said support surface, wherein said support surface is rotatable about the axis.

2. A system in accordance with claim 1, further comprising a drying vent positioned to provide air at least partially to the coverage zone.

3. A system in accordance with claim 2, further comprising a positioning device operable to move said drying vent between a first position, wherein said drying vent provides air to a first portion of the coverage zone, and a second position, wherein said drying vent provides air to a second portion of the coverage zone.

4. A system in accordance with claim 1, further comprising a plurality of drying vents positioned to provide air into, respectively, a plurality of portions of a dryer coverage zone.

5. A system in accordance with claim 1, further comprising a first actuator operable to move said support surface in a direction parallel to the axis between a first position, wherein said support surface is positioned to receive the bulk container, and a second position, wherein said support surface is positioned to place the received bulk container at least partially within the coverage zone.

6. A system in accordance with claim 1, further comprising a first actuator operable to move said at least one washer arm between a first position, wherein said at least one washer arm is positioned to permit said support surface to receive the bulk container, and a second position, wherein said at least one washer arm is positioned such that the received bulk container is at least partially within the coverage zone.

7. A system in accordance with claim 1, wherein said at least one nozzle is switchable into flow communication with each of a plurality of fluids.

8. A system in accordance with claim 1, further comprising a feed source operable to supply the bulk container to said support surface.

9. A system in accordance with claim 1, further comprising a second actuator operable to remove the bulk container from the support surface.

10. A system in accordance with claim 2, further comprising a side wall disposed adjacent to the coverage zone, wherein said drying vent provides air towards said sidewall such that the air is re-directed, at least in part, by said sidewall into the coverage zone.

11. A system in accordance with claim 8, wherein said feed source comprises a conveyor belt.

12. A system in accordance with claim 8, further comprising a first position sensor positioned relative to said feed source, said first position sensor configured to detect a number of bulk containers disposed on said feed source.

13. A system in accordance with claim 8, further comprising a first stop positioned relative to said feed source, said first stop configured to prevent said feed source from depositing a second bulk container onto said support surface when said support surface has received the bulk container.

14. A system in accordance with claim 9, further comprising a removal conveyor belt operable to receive the bulk container from said second actuator and to facilitate removal of the bulk container from said support surface.

15. A system in accordance with claim 14, further comprising a second stop positioned adjacent to said removal conveyor belt, said second stop configured to retain the bulk container on said support surface during washing.

16. A system in accordance with claim 15, further comprising a second position sensor positioned relative to said removal conveyor belt and configured to detect when the bulk container has been moved from said support surface to said removal conveyor belt.

17. A system in accordance with claim 1, wherein said support surface is configured to receive the bulk container having a footprint that covers an area of between about 7 square feet and about 25 square feet.

18. A system in accordance with claim 1, wherein said support surface is fixed with respect to at least one direction and said at least one washer arm is movable along the at least one direction.

19. A system in accordance with claim 1, wherein said support surface is configured to receive the bulk container when said at least one washer arm is in a first position, and wherein said support surface and said at least one washer arm are rotatable relative to each other when said at least one washer arm is in a second position.

20. A system in accordance with claim 1, further comprising a control system communicatively coupled to said support surface and said at least one washer arm, wherein said control system is configured to control at least one of an initiation, a duration, and a conclusion of rotation of said support surface and said at least one washer arm relative to each other and to control at least one of an initiation, a duration, and a conclusion of spraying a fluid from said at least one nozzle of said at least one washer arm.

* * * * *